US005393230A

United States Patent [19]

Vizintin et al.

[11] Patent Number: 5,393,230

[45] Date of Patent: Feb. 28, 1995

[54] FLOATING ELEMENT TO ASSIST THE TEACHING OF SWIMMING

[75] Inventors: Beno Vizintin, Gorizia, Italy; Franci Keber, N.H.M. No. 10, 68290 Sevnica, Slovenia

[73] Assignee: Franci Keber, Sevnica, Slovenia

[21] Appl. No.: 62,178

[22] Filed: May 17, 1993

[30] Foreign Application Priority Data

May 25, 1992 [IT] Italy ..... UD92 A 000099
Sep. 24, 1992 [IT] Italy ..... UD92 A 000144

[51] Int. Cl.[6] ..... A63B 69/12
[52] U.S. Cl. ..... 434/254; 441/106
[58] Field of Search ..... 434/254; 441/106, 114, 441/115, 117, 119, 122, 88

[56] References Cited

U.S. PATENT DOCUMENTS

| | | | |
|---|---|---|---|
| 1,162,909 | 12/1915 | Goldbach | 441/115 |
| 1,253,122 | 1/1918 | Baron | 441/115 |
| 1,759,637 | 5/1930 | Wollik . | |
| 2,753,574 | 7/1956 | Wolshin . | |
| 2,935,751 | 5/1960 | Emmick et al. | 441/114 |
| 3,181,184 | 5/1965 | Potts . | |
| 3,416,172 | 12/1968 | Gerling | 9/337 |
| 3,425,072 | 2/1969 | Carlson | 9/339 |
| 4,011,614 | 3/1977 | Bell . | |
| 5,022,879 | 6/1991 | DiForte . | |

FOREIGN PATENT DOCUMENTS

| | | | |
|---|---|---|---|
| 302122 | 7/1902 | France | B63C 9/10 |
| 601211 | 2/1926 | France | B63C 9/10 |
| 979802 | 12/1959 | France | X63C 9/10 |
| 1268349 | 6/1961 | France . | |
| 7733466 | 4/1978 | Germany . | |
| 0467916 | 9/1952 | Italy | 441/115 |
| 1045549 | 10/1966 | United Kingdom | 441/114 |
| 2003431 | 3/1979 | United Kingdom | B63C 9/10 |
| 2194131 | 3/1988 | United Kingdom | A41F 9/00 |

*Primary Examiner*—Gene Mancene
*Assistant Examiner*—Jeffrey A. Smith
*Attorney, Agent, or Firm*—Antonelli, Terry, Stout & Kraus

[57] ABSTRACT

Inflatable floating element to assist the teaching of swimming, which comprises at least two floating bodies (11*a* and 11*b*), of which at least one can be inflated, and a strap or belt (12) for fixture to a user's body, the two floating bodies (11*a* and 11*b*), namely an inner body (11a) and an outer body (11b) respectively, being united, facing and opposite to each other, while the fixture strap (12) passes at an intermediate position between the two floating bodies (11*a* and 11*b*), cooperates with positioning loops (14) located at about the lengthwise ends of the floating bodies (11*a* and 11*b*) and is clamped when at least one of the two floating bodies (11*a* and 11*b*) has been inflated.

11 Claims, 2 Drawing Sheets

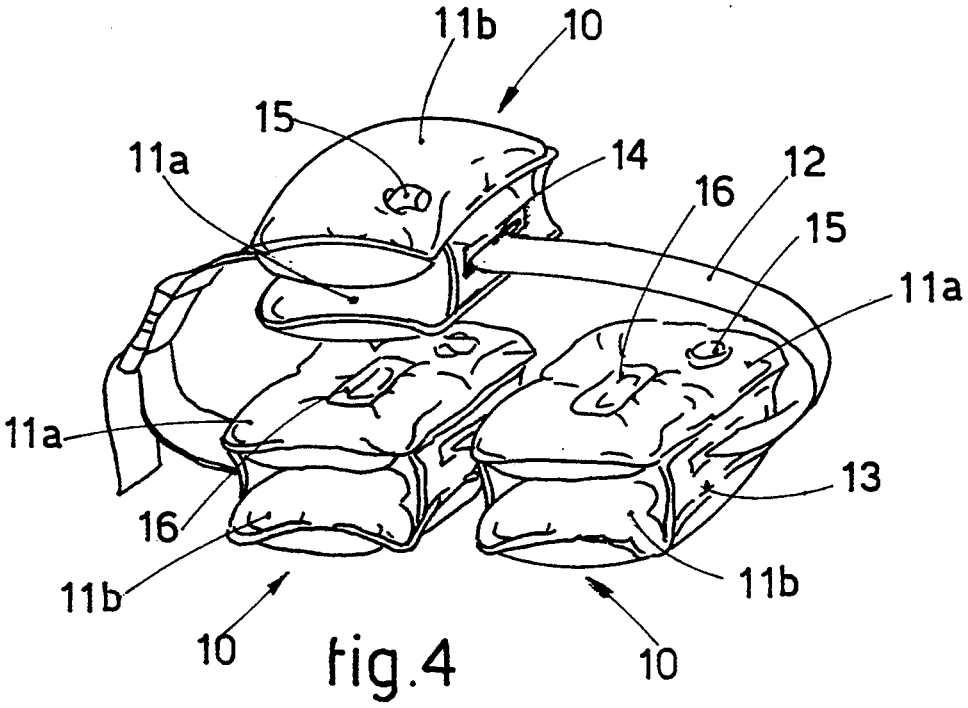
fig.4
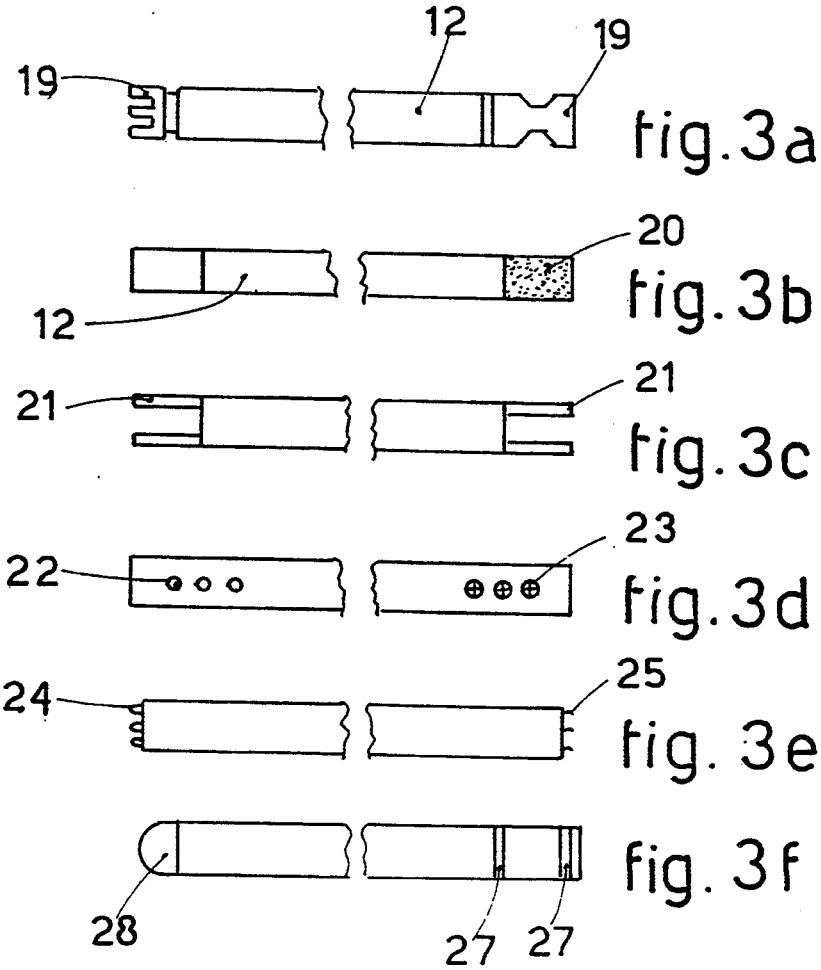
fig.3a
fig.3b
fig.3c
fig.3d
fig. 3e
fig. 3f

FLOATING ELEMENT TO ASSIST THE TEACHING OF SWIMMING

BACKGROUND OF THE INVENTION

This invention concerns a floating element to assist the teaching of swimming, as Set forth in the main claim. To be more exact, the invention concerns a floating element of an inflatable type which can be fitted as desired to various parts of the body.

Owing to the various ways in which it can be used, the floating element according to the invention can be positioned as desired along the human body, so that the best position for floating can be selected to suit the person in question.

Moreover, the floating element according to the invention enables its user to alter the floating power of the floating element as desired and according to requirements.

The state of the art covers various floating elements which are employed while learning to swim or else as an aid for inexperienced swimmers, especially for children.

The most common floating elements are inflatable armlets, which are worn on both arms and help to keep inexpert swimmers afloat; but these armlets are not very practical nor suitable as teaching aids for swimming because their use does not permit floating positions very suitable for learning and because their application hampers the natural movement of the arms.

Floating boards are known with which it is possible to learn the correct movements of the lower part of the body and of breathing but not of the arms.

Furthermore, those boards are generally not fastened to their user, and it is possible to lose contact with, and engagement of, the boards, thus leading to sinking and resulting moments of fear for an inexpert user.

The state of the art includes also elements made in the form of pre-inflated water wings, which can generally be fitted to the back of users, but these latter elements, while they permit a correct floating position, do not enable the floating power to be changed to suit the state of learning of the user. Moreover, they cannot be deflated and are generally bulky and not very practical.

Inflatable floating elements are also known which can be fixed to the positioning belt removably by means of loops, pressure-sensitive adhesive tape, stitching or other means, but these floating elements entail the drawback that the belt comes into contact with the user's body and provides resistance to the expansion of the user's chest while breathing; this is the situation with FR-A-1.268.349 for instance.

Furthermore, the disclosure of that document entails further shortcomings such as the lack of security of the loops through which the belt passes; for the loops are fragile and the floating element can slide along the belt itself.

Moreover, the strap with these elements provides little stability against the floating element, which too possesses little stability in relation to the user's body.

The disclosure of DE-GM-A-7.733.466 involves the drawback of having only one single point of contact between the body of the user and the floating element; moreover, the floating elements can rotate and become positioned incorrectly.

The teaching of U.S. Pat. No. 3,425,072 is not workable since it hampers the natural expansion of the chest, and the rigid material causes unacceptable abrasions on a child's skin and also creates an uncoordinated thrust against the child's back.

The disclosures of U.S. Pat. No. 3,416,172 or GB-A-2,003,431 entail the same shortcomings as U.S. Pat. No. 3,425,072.

SUMMARY OF THE INVENTION

The present applicants have designed, tested and embodied this invention to overcome the shortcomings of the state of the art and to achieve further advantages.

The purpose of the invention is to embody an inflatable floating element which can be fitted to various parts of the body according to requirements so as to enable its user to position himself according to the floating position best for himself.

The inflatable floating element according to the invention consists of at least two opposed, united, inflatable, floating bodies and of one or more straps or belts for application of the inflatable floating element to the user's body; these straps or belts are passed at an intermediate position between the two floating bodies.

The two inflatable floating bodies are joined together by connecting sidewalls or by stitching, welding or other means at least partly along their perimeter.

In the inflatable floating element according to the invention at least one inflatable floating body is especially formed to be an inner floating body, which is used in contact with the user's body.

The inner floating body is positioned between the user's body and the positioning strap, whereas the outer floating body is positioned outside the strap and does not come into contact with the user's body. This enables the inner floating body to act as a cushioning means during breathing and expansion of the user's chest, thus providing a great freedom of expansion of the chest.

Moreover, this configuration enables the tension of the strap to be kept substantially constant and the closure buckle-not to be strained, the expansion of the chest and muscles being absorbed by the deformation imparted to the inner floating body.

Furthermore, a greater stability of the floating element is ensured in relation to the strap, which always remains pressed and clamped between the two inflatable floating bodies when the latter have been inflated.

The two floating bodies, when inflated, are in a condition of mutual compression along their surfaces of mutual contact.

In this way, even if one of the two floating bodies is partly deflated, the expansion of the other floating body compensates the deflation and ensures that enough floating power is retained and that the strap or belt is continuously clamped.

According to a variant the outer floating body has bigger dimensions than the inner floating body. A maximum floating power is achieved in this way, the surface of contact with the user's body being kept small and at the same time a greater freedom of choice being allowed for the most suitable positioning and a greater freedom of movement being obtained.

The inner floating body is shaped in such a way as to have as symmetrical as possible, and advantageously peripheral, a distribution of the points or surfaces of contact with the user's body in relation to the centre of the inner floating body.

Thus, the maximum stability of the floating element according to the invention is ensured, and any rolling or sliding of the floating element on the user's body is prevented.

Moreover, the belt or strap is clamped more securely between the outer floating body and the periphery of the hollow-in the inner floating body.

In the floating elements of the state of the art such rolling takes place during normal swimming activities when the points of contact between the floating element and the user's body are not symmetrical and are not substantially near the centre of the inner floating body.

This distribution of the points or surfaces of contact with the user's body can be obtained, for instance, by one or more points of union (welds, stitches, sewing two air bags together with an intermediate strip in a quilt-like formation) of the sidewalls of the inner floating body, these points being located substantially in the central zone or being distributed in an advantageously symmetrical manner at a plurality of points on the contact surface.

This arrangement creates a suction effect between the the inner floating body, and the user's skin, thus increasing the stability of the inflatable floating element on the user's body.

These points of union may have various shapes and sizes and be oriented in variable directions.

The floating bodies are made of PVC, rubberised fabric or another suitable material and may include an inner air chamber and are equipped with an inflation valve in a suitable position. The inflation valve may be of a normal type or be a safety valve.

Loops are provided on the connecting sidewalls of the two floating bodies so as to enable the strap to be positioned at a desired intermediate position between the two floating bodies.

According to a variant the loops are fixed directly to the inner floating body or to the outer floating body. The strap is then fastened together on the opposite side of the user's body.

The shape of the floating bodies can be varied to enable the floating element according to the invention to take on substantially any aesthetic appearance according to its role as a teaching aid for swimming.

A plurality of inflatable floating elements arranged side by side can be fitted on one strap.

It is advantageous, in particular, to fit a plurality of floating elements during the first periods of instruction so as to increase the floating power and then to reduce the number of the floating elements gradually, for instance by removing one floating element at a time as the ability and practice of swimming develop.

Moreover, the fastening of the strap on the side of the user's body opposite to that facing the floating element can be arranged with various forms of embodiment.

For instance, the strap may have at its end a buckle, made advantageously of a plastic material and provided or not with safety devices to prevent unfastening.

According to other forms of embodiment the strap may include from time to time coordinated elements consisting of pressure-sensitive adhesive tape, knots, buttons, hooks, fastening rings or anything else required to ensure a safe fixture of the strap to the user's body.

According to a variant the outer floating body can consist at least partly of a rigid material.

BRIEF DESCRIPTION OF THE DRAWINGS

The attached figures are given as a non-restrictive example and show some preferred embodiments of the invention as follows:

FIGS. 3*a*–3*f* show some possible embodiments of the system to fasten the strap to the user's body;

FIG. 4 shows a possible application of the floating elements according to the invention;

DETAILED DESCRIPTION OF THE PREFERRED EMBODIMENTS

Figure 1:
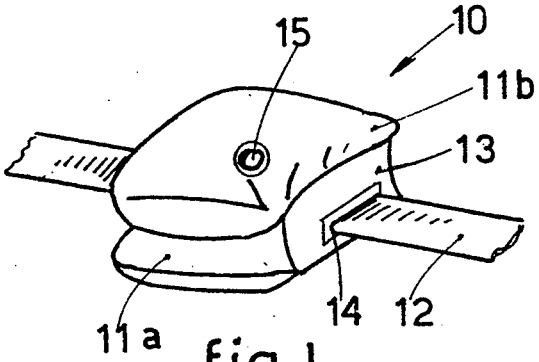
FIG. 1 shows a floating element according to the invention.

The reference number 10 in the figures denotes an inflatable floating element according to the invention. The floating element 10 consists substantially of two opposed floating bodies 11*a* and 11*b* (collectively referred to as 11 herein) having connecting sidewalls 13; at least one of the floating bodies 11 is specially formed and inflatable.

The inflatable floating element 10 cooperates with a positioning strap 12, which fastens the floating element 10 to the user's body and is positioned substantially between the two floating bodies 11.

The strap 12 is pressed in this way between the two floating bodies 11 after the latter 11 have been inflated, thus ensuring the fixture and stable positioning of the strap 12 even during swimming activity.

So as to insert the strap 12 at an intermediate desired position between the two floating bodies 11, the sidewalls 13 are equipped with loops 14, which enable the strap 12 to be passed from one side to the other of the floating bodies 11.

The two floating bodies 11 are defined as an inner floating body 11*a* and an outer floating body 11*b* respectively. The inner-floating body 11*a* is directly in contact with the user's body and acts as a cushion for expansion of the user's chest and does not create either tension on the closure means of the strap 12 or annoying friction of the strap 12 against the user's skin.

The inner floating body 11*a* advantageously has smaller dimensions than the outer floating body 11*b*; the purpose of this is to ensure a smaller surface of contact with the user's body without reducing the floating power of the floating element 10 according to the invention.

The inner floating body 11*a* advantageously has its points or surfaces of contact with the user's body distributed substantially symmetrically and advantageously peripherally in relation to the middle of the inner floating body 11*a*. This creates a suction that enables any rolling to be prevented and ensures a better retention of the floating element 10 in its position during swimming.

Figure 2:
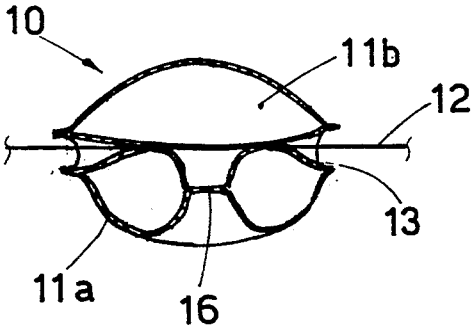
FIG. 2 is a cross-section of the floating element according to the invention.
Figure 8A:
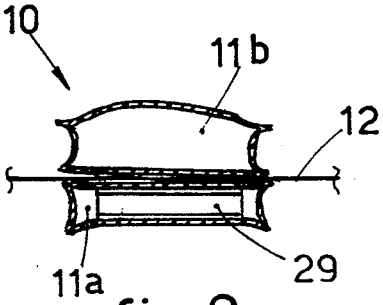
FIGS. 8*a* and 8*b* are cross-sections of two further variants of the floating element according to the invention.
Figure 8B:
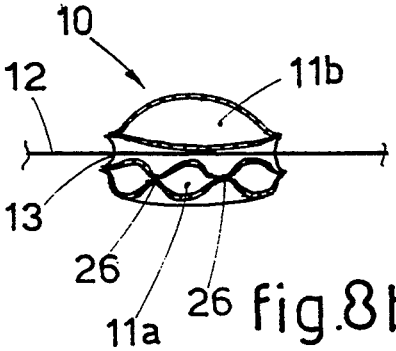

This distribution of the points of contact can be achieved, for instance, by a weld 16 in a substantially central position (FIG. 2) or by one or more quilt-like arrangements 26 (FIG. 8*b*) of the sidewalls of the inner floating body 11*a*.

According to a variant (FIG. 8*a*) this better contact is achieved with a substantially flat configuration of the inner floating body 11*a*, obtained, for instance, by using inner bridges 29 connecting its two outer surfaces; these bridges 29 are inside the inner floating body 11*a* and connect the two outer surfaces thereof and are anchored therewithin.

The floating bodies 11 are equipped with inflation valves 15 in a suitable position, and a plurality of floating elements 10 can be applied to one single strap 12 so as to increase or reduce the floating power according to the degree of training of the user.

FIG. 4 shows a case in which three floating elements 10 are fitted to one strap 12.

According to a variant the uniting sidewalls 13 too can be inflated.

Figure 5:
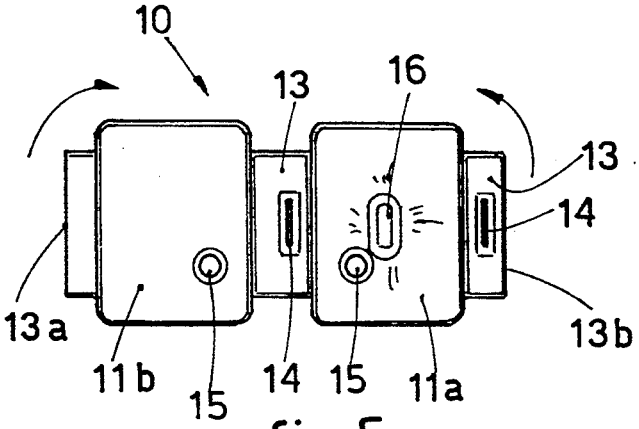
FIG. 5 is a plan view of the floating element of FIG. 1 in an opened position.

FIG. 5 is a plan view of an embodiment of the inflatable floating element 10 according to the invention before the final finishing of the element 10 during production. The inflatable floating element 10 of FIG. 5 is in its opened position. Closure of the floating element 10 is carried out by welding or stitching along the lines 13*a* and 13*b* of the uniting sidewalls 13.

Figure 6:
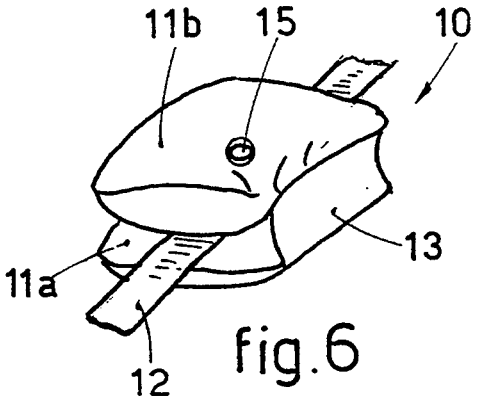
FIG. 6 shows a variant of the floating element of FIG. 1.
Figure 7B:
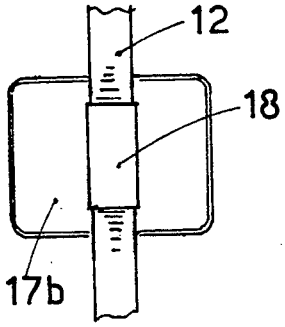
FIGS. 7*a* and 7*b* give respective views of the inner surface of a possible inner floating body and of a possible outer floating body according to the variant of FIG. 6.
Figure 7A:
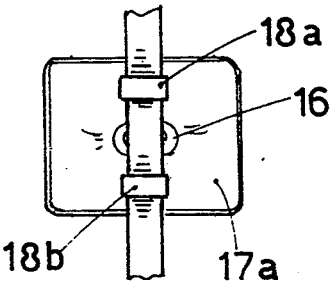

FIG. 6 shows a variant of the floating element 10 of FIG. 1, in which the strap 12 is inserted in a different direction between the two floating bodies 11. In this example loops 18 will be included either on the inner face 17*a* of the inner floating body 11*a* or on the inner face 17*b* of the outer floating body 11*b* (FIGS. 7*a* and 7*b*).

By "inner faces 17*a*–17*b*" of the two floating bodies 11 are meant the reciprocally opposed faces in contact with the positioning strap 12.

Two loops 18*a* and 18*b* (FIG. 7*a*), when fixed to the inner floating body 11*a*, will be located on one side and the other side of the weld 16.

The ends of the strap 12 are provided with suitable fastening and closure means for application of the floating element 10 to the user's body. FIGS. 3*a*–3*f* show some possible embodiments of the fastening and closure means.

In FIG. 3*a* the strap 12 includes a buckle 19 consisting advantageously of a plastic or like or analogous material which cannot deteriorate in contact with water.

FIG. 3*b* shows coordinated adhesive means 20 consisting of pressure-sensitive adhesive tape or other adhesive means which can be separated momentarily.

FIG. 13*c* includes laces 21, whereas FIG. 3*d* shows normal buttons or press-studs 22 with coordinated holes or complementary elements 23 at the other end of the strap 12.

In FIG. 3*e* the strap 12 includes hooks 25 to cooperate with suitable eyelets 24, while in FIG. 3*f* the strap 12 has at one end a common clasp 28 and at least two fastener loops 27 at its other end.

We claim:

1. Inflatable floating element to assist the teaching of swimming to a wearer, comprising:

a plurality of floating bodies, each floating body comprising an inner inflatable body having opposed first and second major surfaces, and an outer inflatable body having opposed first and second major surfaces, said inner inflatable body and said outer inflatable body being united at sidewall portions such that said first major surface of said inner inflatable body is opposed to and faces said first major surface of said outer inflatable body, said second major surface of said inner inflatable body having points of contact with the wearer distributed substantially symmetrically to ensure stable positioning of the floating body on the wearer; and a belt, said belt passing through loops in said sidewall portions of each of said plurality of floating bodies in between said first major surfaces of said inner and outer floating bodies;

a fastener for fastening said belt around the wearer;

wherein said inner floating body acts as a cushion for expansion of the wearer's chest caused by breathing.

2. An inflatable floating element according to claim 1, wherein said first and second major surfaces of each of said inner inflatable bodies are connected at points or zones arranged substantially symmetrically with respect to the center of the inner floating body so as to cause said points of contact with the wearer to be distributed substantially symmetrically.

3. An inflatable floating element according to claim 1, wherein each of said inner inflatable bodies contains an inner connecting bridge inside the inner inflatable body to connect the first and second major surfaces thereof so as to define a substantially flat surface in contact with the wearer.

4. An inflatable floating element according to claim 1, wherein each of said plurality of floating bodies has said inner inflatable body of a smaller dimension than said outer inflatable body thereof.

5. An inflatable floating element according to claim 1, wherein said fastener is a buckle.

6. An inflatable floating element according to claim 1, wherein said fastener comprises pressure-sensitive adhesive tape.

7. An inflatable floating element according to claim 1, wherein said fastener comprises laces.

8. An inflatable floating element according to claim 1, wherein said fastener comprises a button at one end of said belt and button hole at an opposite end of said belt.

9. An inflatable floating element according to claim 1, wherein said fastener comprises a button at one end of said belt and complementary element at an opposite end of said belt.

10. An inflatable floating element according to claim 1, wherein said fastener comprises a hook at one end of said belt and a complementary eyelet at an opposite end of said belt.

11. An inflatable floating element according to claim 1, wherein said fastener comprises a clasp at one end of said belt and at least two fastener loops at an opposite end of said belt.

* * * * *